US008522661B2

(12) United States Patent
Hembise et al.

(10) Patent No.: US 8,522,661 B2
(45) Date of Patent: Sep. 3, 2013

(54) MOBILE EQUIPMENT FOR DETONATING EXPLOSIVES AND A MOTORIZED UNIT FOR SECURING ROADS, TRACKS OR SIMILAR

(75) Inventors: Dominique Hembise, Plaisir (FR); François Sylvain Crosnier, Voisins-le-Bretonneux (FR); Christophe Hubert-Habart, Meudon (FR)

(73) Assignee: MBDA France, Paris (FR)

( * ) Notice: Subject to any disclaimer, the term of this patent is extended or adjusted under 35 U.S.C. 154(b) by 145 days.

(21) Appl. No.: 13/133,596

(22) PCT Filed: Dec. 8, 2009

(86) PCT No.: PCT/FR2009/052431

§ 371 (c)(1),
(2), (4) Date: Jun. 8, 2011

(87) PCT Pub. No.: WO2010/066997

PCT Pub. Date: Jun. 17, 2010

(65) Prior Publication Data

US 2011/0232468 A1 Sep. 29, 2011

(30) Foreign Application Priority Data

Dec. 10, 2008 (FR) ..... 08 06923
Jun. 8, 2009 (FR) ..... 09 02757

(51) Int. Cl.
*B64D 1/04* (2006.01)

(52) U.S. Cl.
USPC ..... 89/1.13; 102/402; 102/403

(58) Field of Classification Search
USPC ..... 89/1.13; 102/402, 403
See application file for complete search history.

(56) References Cited

U.S. PATENT DOCUMENTS

| | | | | |
|---|---|---|---|---|
| 4,727,940 | A * | 3/1988 | Bar-Nefy et al. | 171/84 |
| 5,291,819 | A * | 3/1994 | Hambric | 89/1.13 |
| 5,712,441 | A * | 1/1998 | Grunewald | 89/1.13 |
| 5,979,289 | A * | 11/1999 | French | 89/1.13 |
| 2003/0196543 | A1 * | 10/2003 | Moser et al. | 89/1.13 |
| 2006/0037462 | A1 * | 2/2006 | Marcolla | 89/1.13 |
| 2011/0232468 | A1 * | 9/2011 | Hembise et al. | 89/1.13 |
| 2012/0000350 | A1 * | 1/2012 | Hubert-Habart et al. | 89/1.13 |
| 2012/0210854 | A1 * | 8/2012 | Bitar et al. | 89/1.13 |

FOREIGN PATENT DOCUMENTS

| | | |
|---|---|---|
| EP | 1 054 230 A | 11/2000 |
| EP | 1 371 932 A | 12/2003 |
| EP | 1 429 106 A | 6/2004 |
| EP | 1 688 699 A | 8/2006 |
| WO | WO 02/03007 A | 1/2002 |

OTHER PUBLICATIONS

International Search Report completed Mar. 22, 2010 and mailed Mar. 29, 2010 from corresponding International Application No. PCT/FR2009/052431, filed Dec. 8, 2009 (6 pages).
Written Opinion completed Mar. 22, 2010 and mailed Mar. 29, 2010 from corresponding International Application No. PCT/FR2009/052431, filed Dec. 8, 2009 (13 pages).

* cited by examiner

*Primary Examiner* — Samir Abdosh
(74) *Attorney, Agent, or Firm* — Klein, O'Neill & Singh, LLP

(57) ABSTRACT

The present disclosure relates to mobile equipment for detonating explosives and a motorized unit for securing roads, tracks or similar. According to the present disclosure, the mobile equipment includes a supporting structure with a transverse beam having explosive-activation means mounted thereon, said means comprising at least a mass decoy device, a mechanical decoy device, a thermal electrical decoy device and controllable clearing means.

17 Claims, 4 Drawing Sheets

38
2
42
43
5
D
41
8
40
9
22
15
14
3
26
38
20
1
23
16
18
17
36
7
35
34
21
20
6

16
17
21
15
3
8
12
11
P
P
18
40
43
7
23
13
10
9
4

MOBILE EQUIPMENT FOR DETONATING EXPLOSIVES AND A MOTORIZED UNIT FOR SECURING ROADS, TRACKS OR SIMILAR

CROSS-REFERENCE TO RELATED APPLICATION(S)

This is a national phase application under 35 U.S.C. §371 of PCT Application No. PCT/FR2009/0052431, filed Dec. 8, 2009, which claims the benefit of French application Ser. Nos. 08/06923 filed Dec. 10, 2008 and 09/02757 filed Jun. 8, 2009, the contents of which are expressly incorporated herein by reference.

FIELD OF ART

The present disclosure relates to a mobile equipment intended for detonating explosives such as for instance, improvised explosive devices (IEDs).

BACKGROUND

As known, the proliferation of improvised explosive devices, in particular in areas of conflict, is an ever increasing threat towards (both military or civil) vehicles and individuals following the roads and tracks where they are concealed, because such improvised explosive devices are manufactured in a relatively simple and traditional way from easily commercially available components and/or mechanisms being diverted from their initial use, allowing to design more specifically the cocking and ignition means thereof. Furthermore, the small size of such devices allows them to be concealed easily.

The activation mode of improvised explosive devices laid on roads occurs in particular from vibration or infrared, pressure, traction or breaking wire sensors, being concealed on the verges of roads or completely or partially buried in the ground and being activated upon the passage of the vehicles themselves, resulting in said devices being detonated.

However, in order to fight against the explosives, devices are already known comprising a supporting structure able to be attached at the front of a motorized vehicle such as a tank and mechanical means (with ploughs, beams, rollers, picks and discs) and/or electromagnetic means being integral with the structure so as to activate and destroy mines buried in the ground. However, such mine clearing devices are not adapted for processing traffic roads since they break up the ground upon their progress being in other respects very slow and are not studied nor designed for activating improvised explosive devices, often of small size, and detonating from different actuation modes.

SUMMARY

The present method, system and device aim at overcoming such drawbacks and relates to a mobile equipment of the above mentioned type, the design of which allows to efficiently act against improvised explosive devices and to secure the roads followed as such upon the progress of the vehicle.

To this end, the mobile equipment for detonating explosives, such as, more specifically, improvised explosive devices and of the type comprising a supporting structure able to be connected at the front of a motorized vehicle and on which means are provided for activating said explosives, is remarkable, according to the present method, system and device:

in that said supporting structure consists in a front part with a beam arranged transverse to the forward direction of said vehicle and at least as wide as the latter, and a substantially longitudinal part, able to be connected, via its end, to said vehicle and being integral, via its other end, with said transverse beam front part, and in that said activation means are mounted on said transverse beam front part and comprise at least:

a mass decoy device;

a mechanical decoy device; and an electrical thermal decoy device, said devices being intended for activating, at the front of the vehicle, said explosives detonated respectively by pressure sensors, wire and antenna sensors and infrared sensors.

Thus, thanks to the present method, system and device, the mobile equipment can cope with different actuation modes of the improvised explosive devices, allowing to reduce the vulnerability of the vehicle towards such threats. The simplicity of achievement is however to be noticed for the transverse beam structure advantageously remote from the pushing vehicle through the longitudinal rear part of the structure and the compactness of the material resulting therefrom through installing the different devices of the activation means on the transverse beam itself.

In a preferred embodiment, said mass decoy device comprises wheels arranged at the ends of said transverse beam, in the alignment with the wheels of the motorized vehicle and linked to said beam via oscillating arms submitted to the action of resilient means for pressing said wheels against the ground. Thus, the improvised explosive devices provided with a triggering pressure sensor are actuated upon the passage of the wheels of the device pressed against the ground by the resilient means.

For example, said resilient means are defined by combined spring-shock absorber devices connecting the transverse beam to said respective oscillating arms bearing said wheels.

Preferably, each end of said transverse beam is provided with at least two twin wheels being independent one from the other, allowing to secure a large track width for the passage of vehicles with variable axle widths.

Furthermore, so that the mobile equipment pushed by the vehicle follow to the best the trajectory (bend, curve) imposed by the latter, said oscillating arms bearing said wheels are orientably mounted at each end of said transverse beam around a vertical axis perpendicular to said beam.

Advantageously, said oscillating arms are designed so as to make up a fuse so as to leave the beam and the remaining devices as such further to the explosion of a device through the contact of the wheels.

In a preferred embodiment, said mechanical decoy device comprises a series of vertical spring members distributed throughout the whole length of said transverse beam and the free ends of which have claws and come in contact with the ground, a sling linking the free ends of the spring members and extending parallel to said transverse beam and at least one vertical pole mounted on said beam. Thus, the improvised explosive devices detonated by wire, antenna or similar sensors are activated at the front of the vehicle. It is noticed that the action of the claws on the ground is superficial, so that the roads followed by the equipment are not damaged.

In particular, said claws and said sling are mounted on said vertical spring members by quick fasteners, so that such wear parts are easily replaced.

In a preferred embodiment, said thermal decoy device comprises at least one heating plate linked to an electric source of power for generating at least one heating area with an adjustable operating temperature and arranged in a plane orthogonal to said transverse beam. Thus, the improvised explosive devices detonated by infrared sensors are detected and activated.

More particularly, said thermal decoy device comprises two parallel heating plates, mounted in a protective casing, being supported, around a joint, by a bracket issued from said transverse beam.

According to another characteristic of the present method, system and device, the mobile equipment further comprises controllable clearing means arranged before said supporting structure and allowing, when they occupy a working position, to clear outside obstacles being able to be in its way. Thus, the progress of the vehicle is not stopped, hardly slow down, for the time necessary to clear the obstacles being met (damaged vehicles, blocks of stones, items of any type, etc.) by the clearing means and, furthermore, the source or origin of untimely triggering (false alarms) of some activation means by such obstacles then cleared to the verges of the track being followed, is thereby processed.

Advantageously, said controllable clearing means could comprise at least one blade for pushing said obstacles arranged, in a working position, at least approximately transverse to said forward direction and orthogonally with respect to the ground, and a supporting frame associating, in a jointed and controllable way, said pushing blade with said supporting structure.

In a preferred embodiment, said supporting frame consists in two sub-units assembled together around a jointing axis parallel to said transverse beam of said supporting structure, one of said sub-units being linked on one side to said front part of said supporting structure, around a jointing axis parallel to said transverse beam and the other sub-unit being linked to the other side of said pushing blade around a vertical jointing axis, orthogonal to said transverse beam.

And in order to apply the rotation movements of said supporting frame and of said pushing blade around said respective jointing axes, said controllable clearing means further comprise actuators, for instance jacks.

Thus, the blade could be presented, to the best, with respect to the obstacle being met, as it can rotate to the right or to the left around the vertical axis and more or less rock upwards or downwards around the corresponding horizontal axis, whereas the supporting frame could be lifted or lowered around the corresponding horizontal axis with respect to the supporting structure of the equipment.

For instance, said pushing blade could have a lower edge, facing the ground, comprising rotating rollers for coming in contact with the ground. Such rollers will make it brush against the ground without touching or penetrating it as its main function is to push the obstacles, further preventing its wear.

Furthermore, said mass decoy device comprises, in addition to the wheels arranged at the ends of said transverse beam, internal wheels identical to the previous ones and linked to said beam via oscillating arms submitted to the action of corresponding resilient means. Thus, via such wheel units, a path can be secured (road, track, etc.) throughout the whole width and thus ensure the safe traffic of the convoy following the motorized vehicle pushing the mobile equipment.

The present method, system and device also relates to a motorized unit, intended for securing roads, tracks or similar being able to comprise explosives and remarkable in that it comprises a motorized vehicle and a mobile equipment such as defined above and able to be attached at the front of said motorized vehicle.

BRIEF DESCRIPTION OF THE FIGURES

The figures of the appended drawing will better explain how the present method, system and device can be implemented. In these figures, like reference numerals relate to like components.

DETAILED DESCRIPTION

Figure 1:
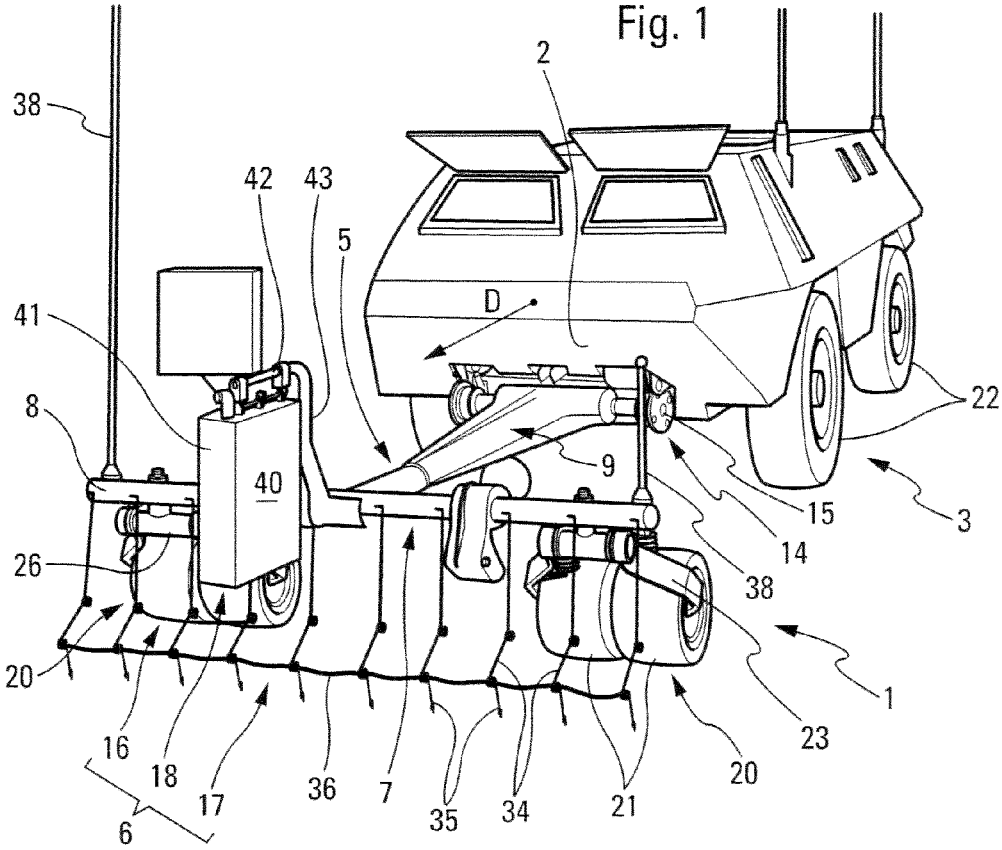
FIG. 1 is a perspective view of an exemplary embodiment of the mobile equipment with its explosive activation means according to the present method, system and device, attached at the front of an armoured vehicle.
Figure 1A:
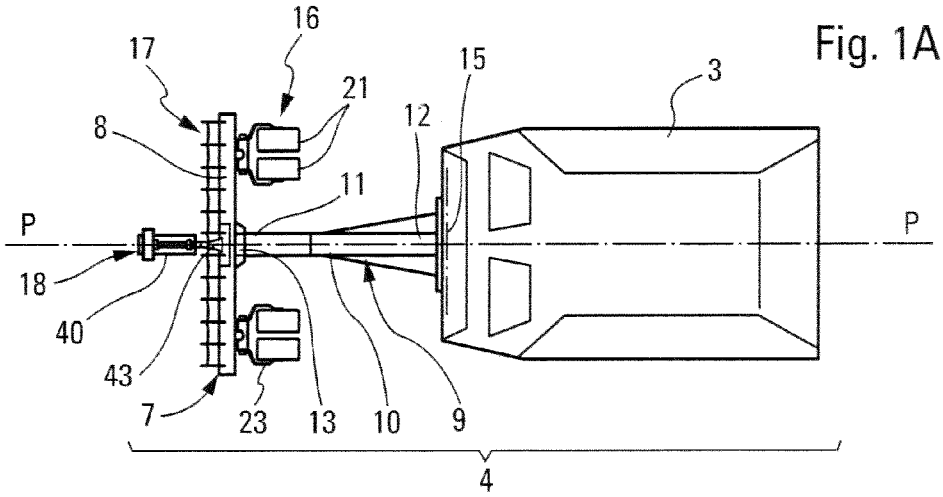
FIG. 1A is a top schematic view of the motorized unit consisting in the detonating equipment and the armoured vehicle.

The mobile working equipment 1 shown on FIGS. 1 and 1A is intended for detonating explosives, such as improvised explosive devices being partially or completely buried in the ground of a road or a track or also concealed on the verges thereof, so as to secure it.

Thus, for ensuring its motion, the mobile equipment 1 is connected to the front 2 of an armoured military vehicle 3 for making up, with the latter, a motorized unit 4.

The equipment 1 mainly comprises a supporting structure 5 making up its frame and activating means 6 for improvised explosive devices, being mounted on the structure.

More particularly, the supporting structure 5 comprises a front part 7 with a beam 8 arranged horizontally and transversally to the forward direction D of the vehicle 2 and being at least as wide as the latter, and a substantially longitudinal rear part 9 in the form of side members or similar 10. Such a rear longitudinal part 9 is arranged in the vertical longitudinal plane of symmetry P of the vehicle, according to the direction D and it is connected, at its front end 11, perpendicularly to the transverse beam 8 in its middle via a link schematically designated as 13 on FIG. 1A and being, preferably, a roll joint according to the side members and, at its other rear end 12, to the rigid front part 2 of the vehicle 3 via a connection device 14 with a clevis, around a horizontal axis 15 perpendicular to the plane of symmetry P of the vehicle and, thus, parallel to the transverse beam.

To this transverse beam 8 activation means 6 are associated, being thus arranged remotely from the vehicle 3 via the rear part 9 with side members of the equipment, protecting said vehicle from the explosion of the devices should they be detonated. Such activation means 6 comprise, in this embodiment shown on FIG. 1, a mass decoy device 16, a mechanical decoy device 17 and an electrical thermal decoy device 18, such devices being specially designed for activating the improvised explosive devices respectively detonated by pressure sensors, wire and antenna sensors and infrared sensors.

Figure 2:
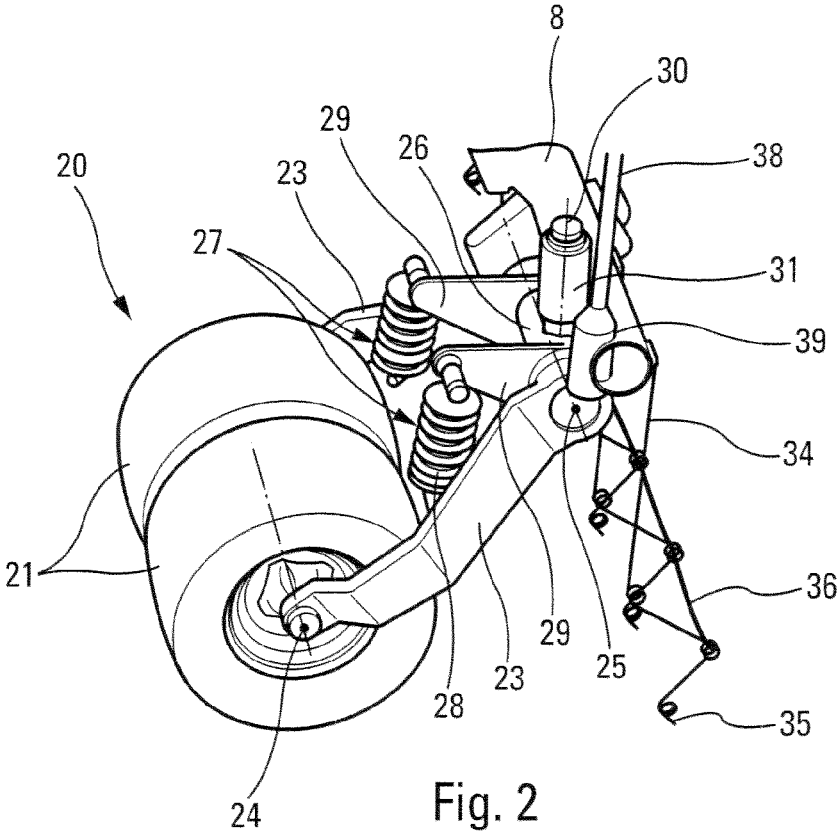
FIGS. 2 and 3 are enlarged partial perspective views of said mobile equipment with its mass decoy and mechanical decoy devices.
Figure 3:
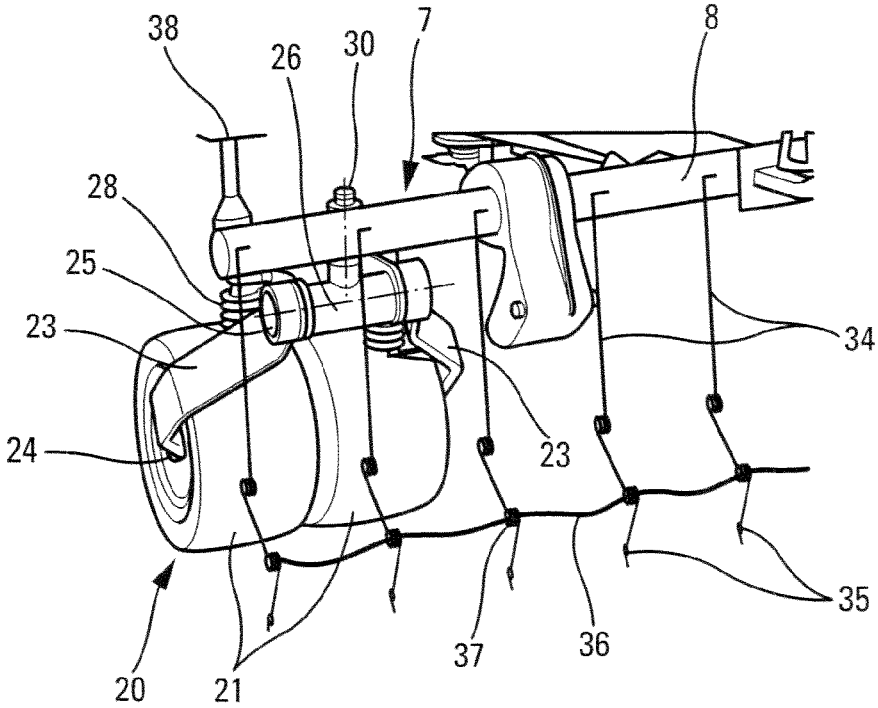

The aim of the device 16 is to act on the pressure sensors of the improvised explosive devices and, to this end, it comprises in this particular embodiment as shown on FIGS. 1, 2 and 3, two identical units 20 having two wheels 21 each, arranged at the ends of the transverse beam 8 of the structure 5 and applying on the ground under resilient constraint for triggering the sensors, as will be explained later on. The two units 20 of wheels 21 are obviously arranged in the alignment of the wheels 22 of the armoured vehicle 3 and are than the latter so as to thereby secure the progress thereof.

As is shown on the FIGS., the two wheels 21 of each unit 20 are arranged on a twin basis, but are independent from each other and each wheel is supported by an oscillating arm 23. Thus, an end of the latter is connected to the wheel through an axis 24 and the other opposite end of the arm 23 is also linked through an axis 25 to a supporting part 26 associated with the beam 8. Les axes 24 and 25 are parallel therebetween and to the transverse beam 8, so that each wheel 21 is able to deflect angularly with respect to the supporting part 26 around its respective axis 25.

Thus, for applying a pressure on the ground, resilient means 27 are provided and are defined, for each wheel, by a combined spring-shock absorber device 28 being arranged between the oscillating arm 23 supporting the wheel 21 and a projecting part 29 of the supporting part 26.

Furthermore, the two units 20 of wheels 21 of the equipment 1 can be oriented and are therefore able to follow the trajectory imposed by the armoured vehicle 3. To this end, each supporting part 26 bears a vertical axis 30, perpendicular to the horizontal transverse beam 8 and engaging in a cylindrical ring 31 being integral with the beam.

Furthermore, the oscillating arms 23 are made so as to make up a fuse, so that they withstand the driving loads but (easily) give way upon a device exploding and prevent the mobile equipment and the remaining devices from being deformed or even destroyed.

The device 17 aims, as far as it is concerned, at acting on the wire or antenna sensors of the improvised explosive devices. To the end, it comprises a set of vertical spring members 34 fastened to the beam and regularly distributed along the latter, so as to define, at the front of the equipment, a protective front at least as wide as the vehicle 3. Such spring members 34 are under the shape of a rod and have their end 35 being claw-free, as shown on FIG. 2, allowing to catch the wires laid or slightly buried in the ground. A transverse sling 36 being substantially parallel to the beam 8 connects the vertical spring members 34, said sling being arranged at some height from the ground, but close to the latter so as to intercept the antennas of the sensors. In order to easily replace them for wear reasons, the claws and the sling are mounted on the spring members through quick fasteners designated by 37 on the FIGS.

The device 17 also comprises two vertical poles 38 mounted in housings 39 provided at the ends of the transverse beam, so as to intercept the sensor air wires. The height of the poles 38 is higher than that of the armoured vehicle 3 provided with its own antennas.

Finally, the aim of the equipment 18 is to act on the infrared sensors for actuating the improvised explosive devices being positioned on the verges of the roads so as to be detonated by the thermal signature generated by the engine unit of the armoured vehicle.

Thus, in the example shown on FIG. 1, the thermal decoy device 18 comprises two identical parallel heating plates 40, being arranged in a plane orthogonal to the transverse beam 8, that is in the vertical longitudinal plane of symmetry of the vehicle. Such two heating plates 40 are thus facing the front right side and the front left side, so as to emit a heating area toward the verges of the road and corresponding, for instance, to the thermal signature of the engine unit of the vehicle, thereby decoying the infrared sensors of the improvised explosive devices being triggered before the passage of the motorized unit 4.

Such heating plates 40 are accommodated in a protective casing 41 jointed at 42 at the free end of a bracket 43, the other end of which is integral with the transverse beam 8 substantially in the middle thereof. An electric source of power (battery or other), not shown and issued from the armoured vehicle 3 supplies the energy needed for heating the plates via electric resistors. As shown on FIG. 1, the bracket 43 shifts to the front of the equipment 1, the thermal decoy device 18, allowing the explosion of the devices to be triggered before the passage of the motorized unit 4. The temperatures of such plates are furthermore electronically regulated.

Such mobile equipment 1 with the devices thereof allows a limitation of the effects of several types of threats triggered by multiple actuation mode sensors.

Figure 4:
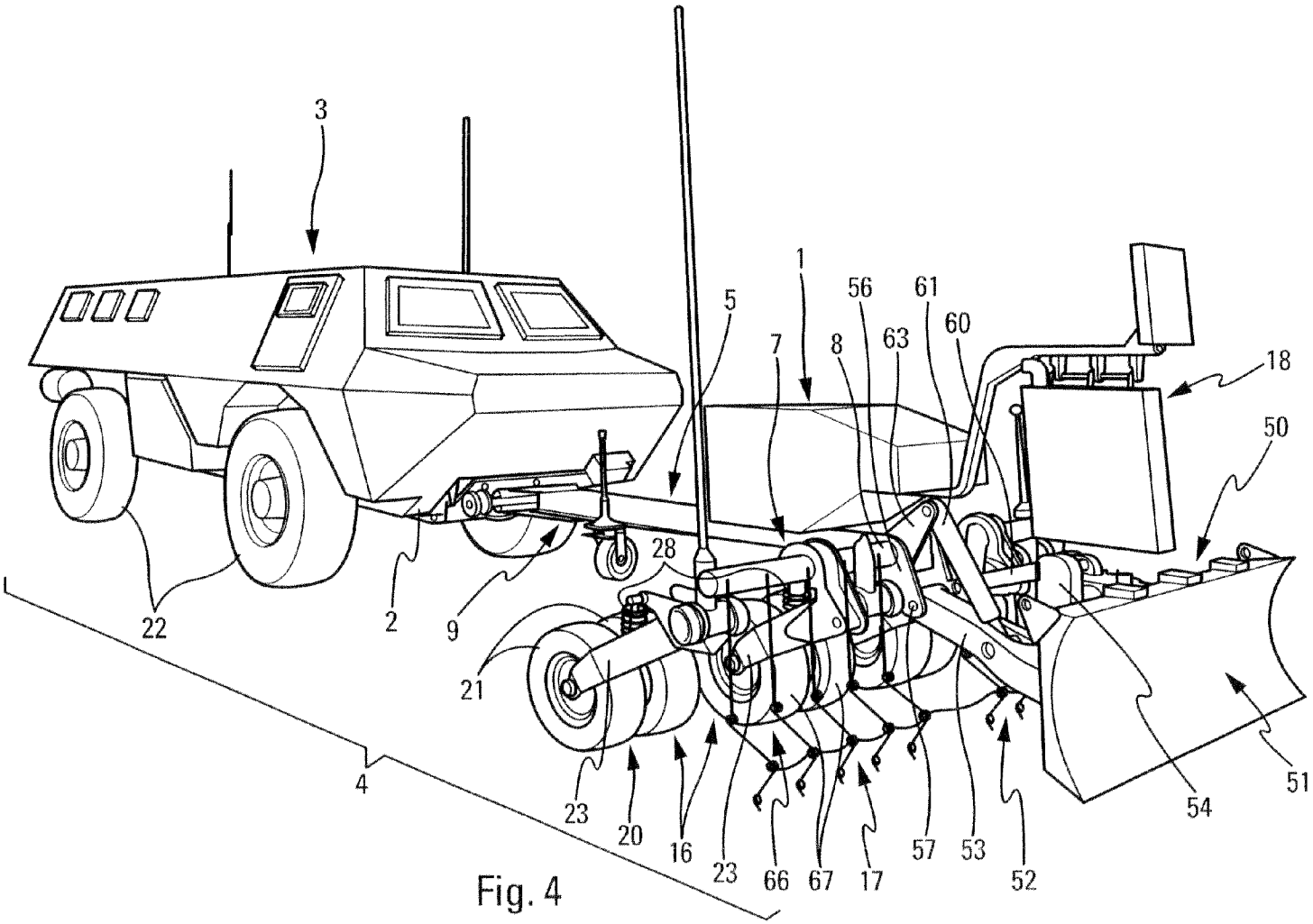
FIG. 4 is a perspective view of the motorized unit with said mobile equipment provided with clearing means.

Furthermore, as shown on FIG. 4, the mobile equipment 1 of the motorized unit 4 is provided, at the front of its supporting structure 5, with means 50 for controllably clearing the road or the track followed by the vehicle 3. Indeed, on the ground of the latter, different obstacles could be present, such as broken down or damaged vehicles, blocks of stones or all kinds of other objects, resulting in the progress of the motorized unit 4 slowing down, the aim of which is to open up a safe track being able to be used subsequently by other following vehicles.

Figure 5:
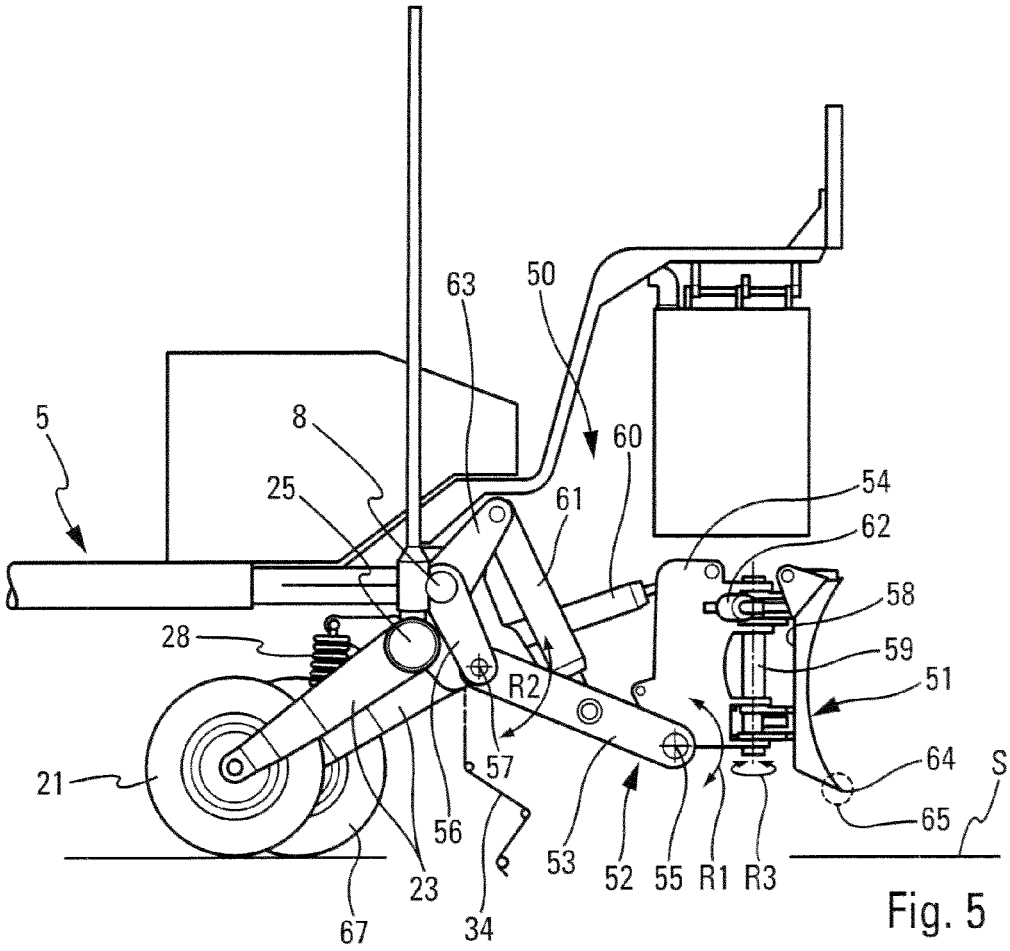
FIG. 5 is a side view of said mobile equipment of FIG. 4.
Figure 6:
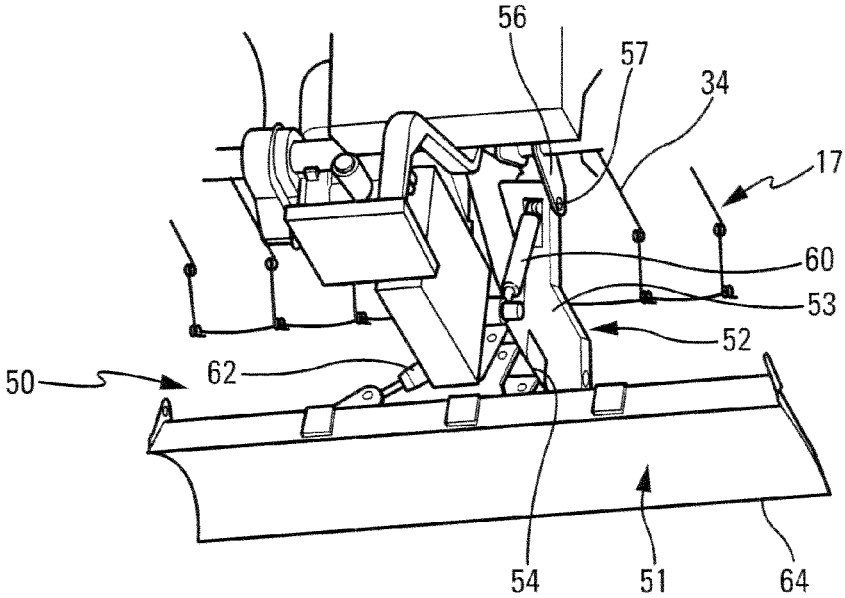
FIG. 6 is a top perspective view of the clearing means.

To this end, it is seen on FIGS. 4 to 6 that the clearing means 50 are defined, in this embodiment, by a pushing blade 51, similar to the blade of a bulldozer and a supporting frame 52 connecting in a joint and controllable way the supporting structure 5 of the mobile equipment 1 to the pushing blade 51. Usually, the latter is positioned, in the working position shown on FIG. 5, in a plane substantially orthogonal to the ground S and is slightly bent in cross-section. The height and the width thereof are determined so as to cope with the different obstacles being met and to protect the activation means 6 of the explosive devices and the supporting structure 5 of the equipment in general.

Geometrically, the supporting frame 52 is positioned in the median continuation of the supporting structure 5 of the mobile equipment 1, that is in the longitudinal plane of symmetry P of the motorized unit 4. And, structurally, it consists in two rigid sub-units or arms 53 and 54 (a first and a second one) associated therebetween in a bent way around a horizontal jointing axis 55 parallel to the transverse beam 8 of the front part 7 of the supporting structure 5 and, thus, perpendicular to the plane P.

Furthermore, the first arm 53 of the supporting frame 52 is facing the supporting structure 5 and is linked, via its end opposite the one jointed to the second arm 54, with radial tabs 56 issued from the horizontal transverse beam 8, around a jointing axis 57 parallel to the jointing axis 55 of the arms. And the second one 54 of them is facing the pushing blade 51 and is linked, via its end opposite the one jointed to the first arm 53, to the rear part 58 of the blade around a vertical axis 59 (FIG. 5), orthogonal to the axes 55 and 57.

And actuators, such as hydraulic jacks 60, 61 and 62 provide the control of the clearing means 50 and of the different movements thereof.

Thus, the hydraulic jack 60 is arranged between the two arms 53 and 54, linking their opposite ends, so as to allow the arms to come closer or remote around the jointing axis 55, according to the rotation R1 being selected and to cause the pushing blade 51 to tip over downwards or upwards around such an axis 55 with respect to the first arm 53.

The hydraulic jack 61 is provided between the first arm 53 and the radial tabs 63 being integral with the transverse beam 8, so as to allow the clearing means 50 (frame and blade) to be moved downwards or upwards with respect to the supporting structure 5 around the jointing axis 57, according to the rotation R2 being selected, in the vertical plane P.

And the hydraulic jack 62 is provided between the second arm 54 and the rear part 58 of the pushing blade 51, so as to allow the latter to be oriented to the left or to the right around the jointing axis 59, according to the rotation R3 being selected and thereby clear the obstacles from the selected side while pushing them to the exterior of the track without additionally damaging the activation devices 16, 17.

Such jacks can naturally be controlled from the piloting cabin of the vehicle 3.

Thus, through such jacks 60, 61, 62 and the rotations R1, R2, R3 they generate around the axes 55, 57, 59, the clearing means 50 could be presented the best possible for clearing the cumbersome obstacle being on the ground S of the track to be secured. More specifically, the supporting frame 52 could take any position in the plane P between the high and low extreme ones and the pushing blade 51, with respect to the first arm 53 of the frame, could tip over more or less so as to "tackle" to the best the obstacle and, with respect to the supporting frame, can rotate to the right or to the left so as to clear the obstacle from the track, whereas the motorized unit 4 progresses.

Furthermore, it should also be noticed that the pushing blade 51 could come in abutment and in contact with the ground S either directly via its lower edge 64 or, preferably, via metallic rollers or rolls rotatable mounted and arranged in line at the level of the lower edge. One 65 of them is shown in broken lines on FIG. 5. Thus, the pushing blade 51 slightly touches the ground S without penetrating into the latter. Moreover, the downward movement of the blade, from a high position to a low position, could occur through gravity, the jack 60 only being active for the reverse kinematics.

It should also be noted on FIGS. 4 and 5 that the equipment has two pairs or units 66 with two wheels 67 each, herein referred to as internal wheel units comparatively to the external units 20 of wheels 21. Such units 66 of internal wheels 67 are linked to the horizontal transverse beam 8 of the structure 5 and are arranged symmetrically with respect to the vertical plane P. And, of course, they are structurally and functionally identical to the external units 20, that is that the twin wheels 67 of each unit 66 are independent and supported by an oscillating arm 23 associated with the beam and receiving a combined spring-shock absorber device 28.

Thus, the spots left by the four units 20, 66 of external wheels 21 and internal wheels 67, after their passage, allow a large and determined track width to be covered and, thus, secured for a safe traffic of the convoy following the motorized unit 4. As the mobile equipment 1 has then a lot of wheels, the maneuvers thereof in narrow locations of the track (hairpins . . . ) will be tricky. In order to facilitate them, a fluid lifting system or similar, not shown, is then provided at the level of the interface with the armoured for lifting the whole mobile equipment and, after the maneuver, put it back on the track.

The invention claimed is:

1. A mobile equipment for detonating explosives comprising:

a supporting structure configured to link to a front of a motorized vehicle; said supporting structure consisting of a front part with a transversally arranged beam comprising a length and a substantially longitudinal rear part configured to link, via an end, to said vehicle and being integral, through its other end, with said transversally arranged beam; and activating devices for activating said explosives, said activating devices comprising a mass decoy device mounted on said transversally arranged beam and configured to activate the explosives by pressure sensors, wherein:

said activation devices further comprise a mechanical decoy device and an electrical thermal decoy device configured to activate the explosives by wire, antenna sensors, or by infrared sensors;

said mechanical decoy and thermal decoy devices are mounted on said transversally arranged beam of said supporting structure; and said transversally arranged beam is at least as wide as said vehicle and said mechanical decoy device extends the length of the beam so as to define a protective front for the vehicle.

2. The equipment according to claim 1, wherein said mechanical decoy device comprises a series of vertical spring members distributed throughout the length of said transversally arranged beam;

said spring members each comprising a free end having claws and configured to come in contact with the ground, a sling linking the free ends of the spring members and extending parallel to said transversally arranged beam, and at least one vertical pole mounted on said beam.

3. The equipment according to claim 2, wherein said claws and said sling are mounted on said vertical spring members by quick fasteners.

4. The equipment according to claim 1, wherein said mass decoy device comprises wheels arranged at two ends of said transversally arranged beam and aligned to a plurality of wheels of the motorized vehicle when mounted to said motorized vehicle; said plurality of wheels linked to said transversally arranged beam by oscillating arms submitted to the action of biasing members so to press said plurality of wheels on the ground.

5. The equipment according to claim 4, wherein said biasing members are defined by combined spring-shock absorber devices linking the transversally arranged beam to said respective oscillating arms bearing said wheels.

6. The equipment according to claim 4, wherein each end of said transversally arranged beam is provided with at least two twin wheels being independent from each other.

7. The equipment according to claim 4, wherein said oscillating arms bearing said wheels are orientably mounted at each end of said transversally arranged beam around a vertical axis perpendicular to said transversally arranged beam.

8. The equipment according to claim 4, wherein said oscillating arms are achieved so as to make up a fuse.

9. The equipment according to claim 1, wherein said electrical thermal decoy device comprises at least one heating plate connected to an electric source of power for generating at least one heating area with an adjustable operating temperature and arranged in a plane orthogonal to said transversally arranged beam.

10. The equipment according to claim 1, wherein said electrical thermal decoy device comprises two parallel heating plates mounted in a protective casing being supported by a bracket.

11. The equipment according to claim 1, further comprising controllable clearing devices located before said supporting structure to clear outside obstacles.

12. The equipment according to claim 11, wherein said controllable clearing devices comprise at least one pushing blade for clearing said obstacles; said at least one pushing plate arranged, in a working position, at least approximately transversally to said front of said motorized vehicle and orthogonally with respect to the ground and a supporting frame.

13. The equipment according to claim 12, wherein said supporting frame comprises two sub-units assembled one to the other around a jointing axis parallel to said transversally arranged beam, one of said sub-units being linked on one side of said front part of said supporting structure and the other sub-unit being linked to the other side of said pushing blade around a vertical jointing axis, orthogonal to said transversally arranged beam.

14. The equipment according to claim 12, wherein said controllable clearing devices further comprise actuators for applying rotational movement of said supporting frame and of said pushing blade around said respective jointing axes.

15. The equipment according to claim 12, wherein said pushing blade has a lower edge, facing the ground, comprising rotating rollers configured for coming in contact with the ground.

16. The equipment according to claim 4, wherein said mass decoy device comprises, in addition to the wheels arranged at the ends of said transversally arranged beam, internal wheels and linked to said beam via oscillating arms submitted to the action of corresponding resilient means.

17. A motorized unit comprising a motorized vehicle and mobile equipment as defined according to claim 1 and being attached to the front of said motorized vehicle.

* * * * *